US012745812B2

(12) United States Patent
Wende et al.

(10) Patent No.: US 12,745,812 B2
(45) Date of Patent: Sep. 29, 2026

(54) DUTY BELT

(71) Applicant: 5.11, Inc., Costa Mesa, CA (US)

(72) Inventors: Uwe Wende, Hamburg (DE); Matthew David Noble, Long Beach, CA (US)

(73) Assignee: 5.11, INC., Costa Mesa, CA (US)

( * ) Notice: Subject to any disclaimer, the term of this patent is extended or adjusted under 35 U.S.C. 154(b) by 0 days.

(21) Appl. No.: 19/348,637

(22) Filed: Oct. 2, 2025

(65) Prior Publication Data

US 2026/0101947 A1 Apr. 16, 2026

Related U.S. Application Data

(60) Provisional application No. 63/707,088, filed on Oct. 14, 2024.

(30) Foreign Application Priority Data

Oct. 14, 2024 (DE) ..... 102024129725.5

(51) Int. Cl.
*A41F 9/00* (2006.01)
*A45F 5/02* (2006.01)

(52) U.S. Cl.
CPC ..... *A41F 9/002* (2013.01); *A45F 5/021* (2013.01)

(58) Field of Classification Search
CPC ..... A45F 5/021; A41D 9/002
See application file for complete search history.

(56) References Cited

U.S. PATENT DOCUMENTS

| | | | |
|---|---|---|---|
| 2,392,761 | A | 1/1946 | Pease, Jr. |
| 4,898,310 | A | 2/1990 | Remington |
| 5,152,443 | A | 10/1992 | Hagan |
| D344,029 | S | 2/1994 | Sullivan |
| 5,316,022 | A | 5/1994 | Schiek, Sr. |
| 5,386,593 | A | 2/1995 | Kleinman |
| 5,586,969 | A | 12/1996 | Yewer, Jr. |
| D451,605 | S | 12/2001 | Snider |
| 6,481,528 | B2 | 11/2002 | Antonio |
| 7,762,440 | B2 | 7/2010 | Cook |
| 7,950,554 | B2 | 5/2011 | Hoffner et al. |
| D721,466 | S | 1/2015 | Boyles et al. |

(Continued)

OTHER PUBLICATIONS

DE102024129725.5, "Search Report", Jun. 23, 2025, 12 pages.

(Continued)

*Primary Examiner* — Katherine M Moran
(74) *Attorney, Agent, or Firm* — Kilpatrick Townsend & Stockton LLP

(57) ABSTRACT

A core member for a duty belt can include a series of segments, which can include a first support segment, a second support segment, and a joint segment. The joint segment may be connecting the first support segment and the second support segment, The joint segment may include a bridge portion bounded above and below by notches, The joint segment with bridge portion and the notches may facilitate relative rotation between the first support segment and the second support segment about a rotation axis perpendicular to a length of the belt, which may facilitate suitable hinging when the belt is moved toward a frustoconical orientation in a worn configuration to provide an adaptive fit suitable to accommodate variations in waistline shape among different users.

17 Claims, 9 Drawing Sheets

(56) References Cited

U.S. PATENT DOCUMENTS

| | | | | |
|---|---|---|---|---|
| 8,985,411 | B2 | 3/2015 | Mongan et al. | |
| 9,339,102 | B2 | 5/2016 | Iosilevich et al. | |
| D901,830 | S | 11/2020 | McWiggan et al. | |
| 11,497,279 | B2 | 11/2022 | Kirseh | |
| 12,035,772 | B2 * | 7/2024 | Fiero | F41C 33/046 |
| 12,396,507 | B1 * | 8/2025 | Davis | A41F 17/02 |
| 2003/0135913 | A1 | 7/2003 | Yang | |
| 2021/0137252 | A1 | 5/2021 | Knudsen | |
| 2023/0086647 | A1 * | 3/2023 | Kozak | A45F 5/021 2/321 |
| 2023/0292865 | A1 | 9/2023 | Florio et al. | |

OTHER PUBLICATIONS

German Patent Application No. 102024129725.5, filed Oct. 14, 2024.

Application No. DE102024129725.5 , Office Action, Mailed On Mar. 30, 2026, 8 pages.

* cited by examiner

DUTY BELT

CROSS-REFERENCES TO RELATED APPLICATIONS

This application claims the benefit of and priority to U.S. Provisional Patent Application 63/707,088, filed Oct. 14, 2024, and claims priority to German Patent Application No. 102024129725.5, filed Oct. 14, 2024, which are herein incorporated by reference in their entireties for all purposes.

The present invention relates to a duty belt, a core member for a duty belt, and a method of incorporating a core member into a belt.

BACKGROUND OF THE DISCLOSURE

Duty belts may be used by personnel in law enforcement, military, or other tactical settings. Duty belts may be utilized to carry gear in position to be readily accessible for wearers. However, gear may add weight that may contribute to user discomfort that is desirable to avoid.

BRIEF SUMMARY OF THE DISCLOSURE

The following presents a simplified summary of some embodiments of the present disclosure in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Any embodiment described in the following may be combined with any other described embodiment, unless specified otherwise or if conceptually incompatible. Features, advantages or alternative embodiments described herein in the context of the duty belt can be assigned to the claimed core member and the claimed method, and vice versa.

According to a first device aspect of the present disclosure, a duty belt is provided. The duty belt comprises a core member having a longitudinal direction configured to at least partially encircle a wearer along hips of the wearer in a worn position. The core member further has a height direction configured to be aligned with a direction of gravity in the worn position. The core member further has a depth direction configured to be aligned with a radially inward direction facing toward the wearer in the worn position. The core member comprises a series of segments including a first support segment, a second support segment, and a joint segment connecting the first support segment and the second support segment. The joint segment comprises a bridge portion bounded above and below in the height direction by notches. The core member is sized such that a narrowest portion of the joint segment in the height direction is less than 65% of a narrowest portion of the second support segment in the height direction. The joint segment is configured to facilitate relative rotation between the first support segment and the second support segment about a rotation axis extending in the depth direction.

The core member may be capable of exhibiting some degree of tilt, such as to approximate a frustoconical surface.

Some degree of tilt may be present for the height direction (e.g., to extend upward and at least partially radially inward), such as in situations in which the encircling configuration arranges the core member in a frustoconical orientation and/or in the worn position.

Material for the core member may be suitably durable to facilitate load-bearing and/or supporting gear to be mounted on the duty belt. Additionally, or alternatively, material for the core member may be suitably flexible to permit bending and/or wrapping around contours of the wearer. The material for the core member may enable bending from a laid-out flat configuration to an encircling configuration and back to a laid-out flat configuration without undergoing permanent or plastic deformation, for example.

In various embodiments, the core member has an upper length along a top margin and a lower length along a bottom margin. The lower length of the core member may be longer than the upper length of the core member such that the core member exhibits a bowed curvature in an at-rest laid out state.

In various embodiments, the core member includes a center between opposing ends along the longitudinal direction. The bowed curvature may be measurable by a top-center offset distance. The top-center offset distance may correspond to a distance between a top plane arranged to extend through uppermost extremities at the opposing ends of the core member and a highest extremity at the center of the core member. The bowed curvature may be such that the top-center offset distance is exceeding 5 centimeters.

The curvature may facilitate arrangement of the core member in a frustoconical arrangement in the worn position.

Suitably sizing the curvature can allow the core member to adopt a frustoconical orientation in an encircling configuration. A frustoconical orientation can allow a face of the core member to be positioned against the wearer's hip, which may provide a larger surface for distribution of weight than if a lower edge (with smaller profile and thus greater force concentration) of a belt surface is instead positioned in contact as a point load along the wearer's hip. Thus, for example, where a particularly heavy set of equipment to be borne on a belt may be prone to concentrate load through contact of a lower belt edge with hips of the wearer and lead to discomfort and/or negative effects such as bruising and/or hematoma, the same set of equipment may be supported by the core member with weight distributed across a larger area from the frustoconical orientation to avoid such negative effects while supporting a similar set of equipment that may cause such negative effects in other known forms of belts.

In various embodiments, the core member is sized such that an overall length of the joint segment in the longitudinal direction is less than 45% of an overall length of the second support segment in the longitudinal direction.

Lengths may be included in larger amounts for larger sizes (such as for medium, large, extra large, etc.), in smaller amounts for smaller sizes (such as for extra small), and/or in other differing combinations.

In various embodiments, a sheet of flexible material is secured overlaying the joint segment in the depth direction and has stretch characteristics biasing the core member toward a default position.

The core member may be able to flex to allow the duty belt to hinge at the joint segments, e.g., based on including suitable features, geometry, dimensions, and/or ratios. For example, the hinging action provided by suitable dimensions (such as with one or more of the ratios described herein) may allow the duty belt to sit along and/or atop the hips in a more comfortable fashion than if the hinging ability were not present. Additionally or alternatively, the hinging may allow the duty belt to avoid crumpling or wrinkles along the length of the joint segments that could cause undue strain in the material and/or discomfort for the wearer (such as when moved toward and/or into the encircling configuration of being worn and/or in a frustoconical orientation). Additionally or alternatively, the hinging may permit movement or accommodation of different girths of user, for example. Stated another way, in general, the core member may facilitate relative rotation between the support segments about a rotation axis perpendicular to a length of the duty belt, which may facilitate suitable hinging when the duty belt is moved toward a frustoconical orientation in a worn configuration to provide an adaptive fit suitable to accommodate variations in waistline shape among different users.

In various embodiments, the notches are shaped (e.g., triangular) notches and the core member comprises at least one radiused or rounded surface along at least one corner of the notches.

A (e.g., triangular) shape for the notches may facilitate relative rotation of the support segments. The (e.g., triangular) shape of the notches may impart a step function-like shape to the core member, such as shapes of the support segments interrupted or alternating with shapes for the joint segments. A substantially symmetric extension of the step-function may be present, such as imparting symmetry in the core member in one or more areas across the longitudinal axis, across a vertical axis along the height direction, or otherwise.

A triangular shape may provide space between sloped sides that may allow the support segments to rotate toward each other and/or provide suitable limits or stops to the rotation.

The triangular shape may be established without sharp corners. For example, the triangular shape may include at least one radiused or rounded surface along at least one corner of the triangular shape for the notch.

In various embodiments, the joint segment is a first joint segment, and the core member further comprises a third support segment and a second joint segment connecting the third support segment and the second support segment. The second joint segment may comprise a second bridge portion bounded above and below in the height direction by notches. The second joint segment may be configured to facilitate relative rotation between the third support segment and the second support segment about a second rotation axis extending in the depth direction.

For example, the first joint segment and the second joint segment may be arranged on either side of the second support segment that may be sized to be positioned along a back of a wearer, and the first support segment and the third support segment may respectively be sized to extend outward from the first joint segment and the second joint segment to define portions that can extend along the hips and toward a front of the wearer.

Generally, the support segments may be suitably sized and/or shaped to support gear to be supported by the duty belt, and the joint segments may facilitate relative rotation of the support segments. The relative rotation of the support segments may be about a rotation axis extending in the depth direction, for example. Relative rotation of the support segments may enable the core member to adapt to variations in body shape and size among different wearers (e.g., which may enable faces of the support segments to rest more fully against the body to provide a larger amount of surface area and distribute load more fully than if a portion of the support segment were instead held out of alignment by inflexibility of the core member and resulted in a smaller surface area in contact to distribute load).

In various embodiments, the duty belt further comprises an outer belt that contains the core member and an inner belt releasably couplable with the outer belt.

According to a second device aspect of the present disclosure, a core member for a duty belt is provided. The core member comprises a series of segments that include a first support segment, a second support segment, and a joint segment connecting the first support segment and the second support segment. The joint segment comprises a bridge portion bounded above and below by notches. A narrowest portion of the joint segment in the height direction is less than 65% of a narrowest portion of the second support segment in the height direction.

In various embodiments, the series of segments includes a pattern of support segments and joint segments alternating with one another.

In various embodiments, the core member has an upper length along a top margin and a lower length along a bottom margin. The lower length of the core member may be longer than the upper length of the core member.

In various embodiments, the duty belt further comprises a cover formed from a sheet of material overlaying the joint segment, for example, in the depth direction, e.g., so as to cover the notches and/or joint segments of the core member.

The cover may cover the joint segments and/or otherwise avoid or prevent pinching that could be a risk of occurring at the joint segment during relative rotation of the support segments. Additionally, or alternatively, the cover may provide a biasing effect. For example, the core member may include a durable material while the sheet that forms the cover may include a flexible sheet that is more stretchable than the durable material. The cover may be fixed (e.g., via stitching etc.) at suitable locations to the durable material of the core member such that the stretch characteristics of the flexible sheet of the cover impart a bias toward a default position of the core member. Additionally, or alternatively, the cover may work against twisting at the joint segments, such as twisting about a longitudinal axis that might otherwise cause the duty belt to bind and/or not lay in a fully conforming orientation along the wearer.

In various embodiments, the core member comprises a durable material and the sheet comprises a flexible sheet that is more stretchable than the durable material and is fixed to the durable material such that stretch characteristics of the flexible sheet impart a bias toward a default position of the core member.

In various embodiments, the core member is sized such that an overall length of the joint segment in the longitudinal direction is less than 45% of an overall length of the second support segment in the longitudinal direction.

In various embodiments, the first support segment, the joint segment, and the second support segment are formed of a continuous strip of material.

Having the core member include a continuous strip extending through at least one joint segment and adjoining support segments can allow portions to remain connected in order to ensure that undesirable lengthening of the belt does not occur (which could otherwise be the case if the material of the joint segment were instead only a connection formed of relatively flexible material). Forming a given notch, joint segment, and/or support segment may be accomplished by cutting the material or by arranging along projections in a mold that may impart a corresponding void in a fabricated workpiece, for example.

According to a method aspect of the present disclosure, a method is provided. The method comprises a step of accessing a core member comprising a series of segments that include a first support segment, a second support segment, and a joint segment connecting the first support segment and the second support segment. The joint segment comprises a bridge portion bounded above and below by notches. A narrowest portion of the joint segment in the height direction is less than 65% of a narrowest portion of the second support segment in the height direction. The method further comprises a step of incorporating the core member into a belt.

In various embodiments, incorporating the core member into a belt comprises attaching a sheet of material that is more flexible than the core member in a position overlaying the joint segment.

In various embodiments, incorporating the core member into a belt comprises incorporating the core member into an outer belt. The method may further comprise coupling the outer belt with an inner belt to form a duty belt.

In various embodiments, the method may further comprise a step of coupling the core member with pads.

Generally, the pads may be positioned to sit at relevant anatomical positions, such as along the hips and/or tail bone. In some embodiments, the inner belt may be donned extending through belt loops on a wearer's pants or shorts, and the outer belt may be secured to the donned inner belt, such as by keepers. Keepers additionally or alternatively may be used to hold the pads relative to the outer belt and/or the inner belt. The pads may be positioned along inner or outer surfaces of the outer belt and/or the inner belt as desired.

In various embodiments, the method may further comprise a step of coupling the core member with a second (e.g., inner) belt.

In various embodiments, the method may further comprise a step of coupling the core member with keepers configured for holding separable parts together.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION OF THE DISCLOSURE

Figure 1:
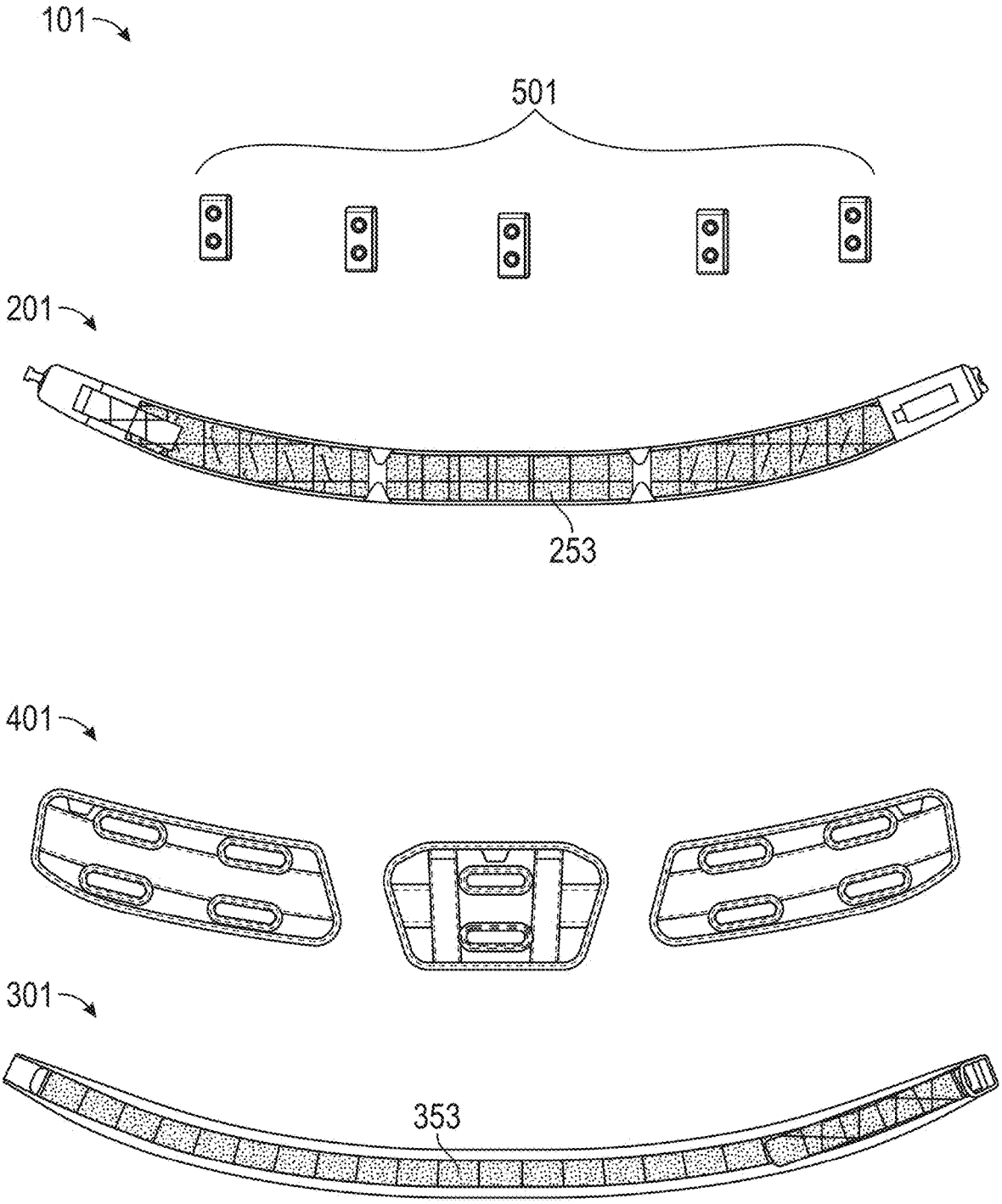
FIG. 1 illustrates an exploded view of examples of components of a duty belt in accordance with various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Reference will now be made to the drawings. It can be understood that the drawings may include ornamental and aesthetic design features as aspects of the present disclosure. While some views of the ornamental and aesthetic are shown in the drawings, further orthogonal, perspective, and cross-sectional views can be logically extrapolated and supported by these drawings. Such ornamental and aesthetic design can be appreciated as separate from, integrated with, or existing parallel to the functionality of the overall disclosure; however, the ornamental appearances shown in the drawings is not a design solely or primarily driven or dominated by the function of the disclosure. Indeed, particular contours, boundaries, or other aspects of the drawings shown herein may have no relevance or contribution to the ornamental and aesthetic design of the disclosure.

Like reference numerals refer to like elements throughout the drawings. In many instances, similar elements may be identified by the same reference numeral and differentiated by a different letter suffix in the drawings. For example, a reference numeral with a letter may refer to a specific instance of an element, and the reference numeral without an accompanying letter may refers to the element generically or collectively. Thus, as an example (not shown in the drawings), in the following text description, elements may be referenced with suffixes (e.g., for referencing individual or specific elements such as a first device 12A or a second device 12B) or without suffixes (e.g., for generally or collectively referencing elements such as one or more of the devices 12). Moreover, to avoid obscuring features in the figures, lead lines from reference numerals may reach to less than all possible examples, such that it may be understood that some other depicted features may correspond to an example of a feature denoted by a reference numeral even if no explicit lead line is present between the numeral and the depicted feature(s).

FIG. 1 illustrates a duty belt 101. The duty belt 101 is shown with examples of a variety of sub-components arranged exploded from one another for ease of viewing and distinguishing. The duty belt 101 may include an outer belt 201, an inner belt 301, a set of pads 401, and a set of keepers 501. Although examples of all of these components are shown in FIG. 1 more, fewer, and/or different components may be utilized in use.

The components may be suitably oriented for combining together into the duty belt 101. For example, the view in FIG. 1 shows mating sides of the outer belt 201 and the inner belt 301. In use, one or the other may be flipped over (e.g., horizontally and/or about an axis extending vertically along the page) so that the two mating sides may engage one another with suitable structure, which may include examples discussed in greater detail with respect to other figures herein. As a non-limiting example of suitable structure for coupling the outer belt 201 with the inner belt 301, a fastener strip 253 on an inner face of the outer belt 201 may be engaged with a fastener strip 353 on an outer face of the inner belt 301. As another non-limiting example, one or more of the keepers 501 may be arranged as a ring extending around both the outer belt 201 and the inner belt 301 to hold the parts together.

Generally, the pads 401 may be positioned to sit at relevant anatomical positions, such as along the hips and/or tail bone. In some embodiments, the inner belt 301 may be donned extending through belt loops on a wearer's pants or shorts, and the outer belt 201 may be secured to the donned inner belt 301, such as by the keepers 501. Keepers 501 additionally or alternatively may be used to hold the pads 401 relative to the outer belt 201 and/or the inner belt 301. The pads 401 may be positioned along inner or outer surfaces of the outer belt 201 and/or the inner belt 301 as desired.

Figure 2:
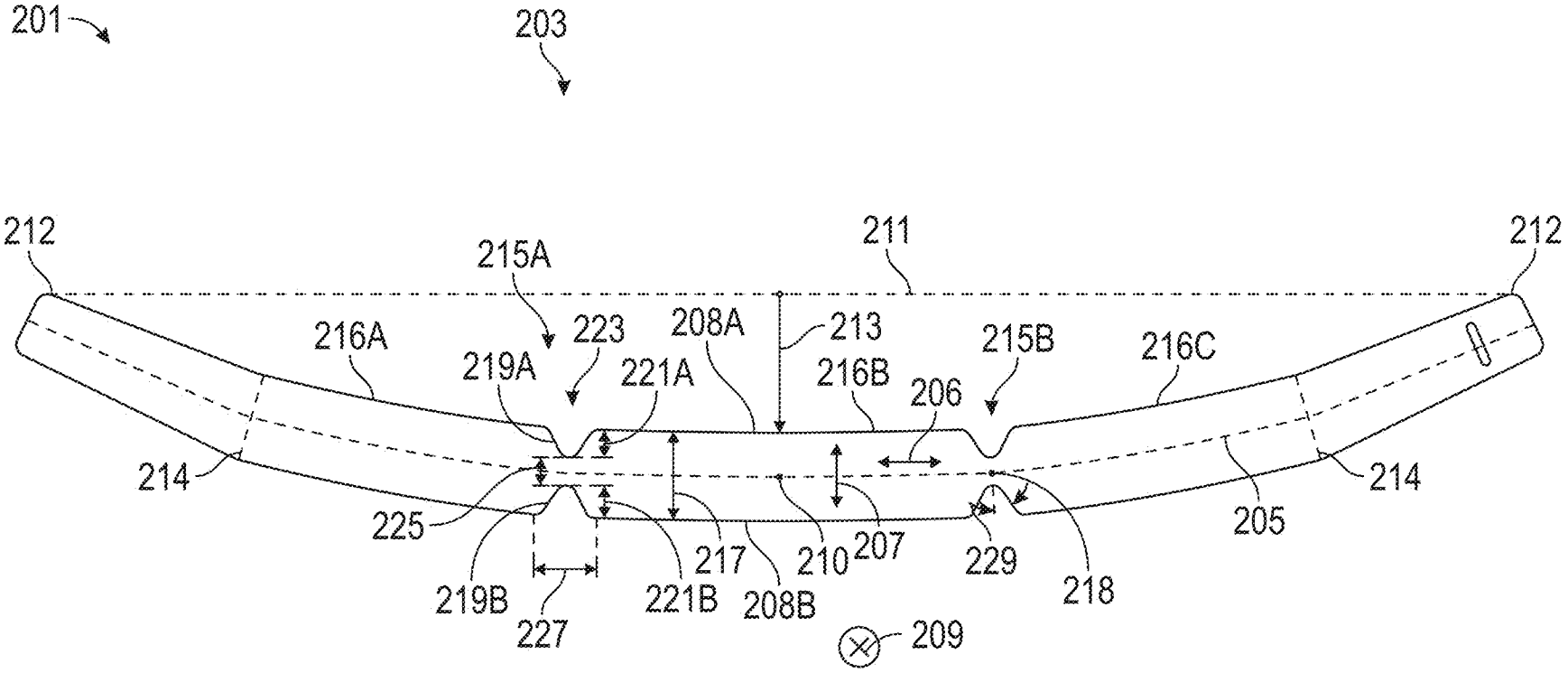
FIG. 2 illustrates an example of a core member that may be included in the duty belt of FIG. 1, such as in an outer belt of the duty belt in accordance with various embodiments.

Turning to FIG. 2, the outer belt 201 can include an inner or core member 203. The core member 203 and/or other portions of the duty belt 101 can extend in, include, and/or be defined in any of one or more suitable directions relative to which features may be oriented in use. For ease of explanation, various examples of reference directions will be initially described relative to a laid-out flat configuration of the core member 203 such as shown in FIG. 2, although it may be appreciated that orientations of such directions may also undergo some amount of variation in use in response to movement away from the laid-out flat configuration.

As one example, the core member 203 can extend in, include, and/or be defined in a length or longitudinal direction 206. The longitudinal direction 206 is represented primarily in the left-right direction in the view in FIG. 2. The longitudinal direction 206 may correspond to and/or extend along a longitudinal axis 205. The longitudinal axis 205 may extend along a length of the core member 203, such as through a center 210 of the core member 203 and/or between opposite lateral ends 212. The longitudinal axis 205 may correspond to a portion of the core member 203 configured to at least partially encircle a wearer along a waist and/or hips in a worn position in use. For example, the opposite lateral ends 212 may be drawn toward one another to move the core member 203 toward an encircling configuration (e.g., away from the laid-out flat configuration shown). In the encircling configuration, the core member 203 may be capable of exhibiting some degree of tilt, such as to approximate a frustoconical surface.

As another example, the core member 203 may extend in, include, and/or be defined in a height direction 207. The height direction 207 is represented primarily in the up-down direction in the view in FIG. 2. The height direction 207 may be configured to be aligned generally with the direction of gravity in the worn position and/or to extend between an upper margin 208A and a lower margin 208B of the core member 203, for example. The height direction 207 may be substantially perpendicular to the length direction 206, such as in the laid-out flat configuration. However, some degree of tilt may also be present for the height direction 207 (e.g., to extend upward and at least partially radially inward), such as in situations in which the encircling configuration arranges the core member 203 in a frustoconical orientation and/or in the worn position.

As a further example, the core member 203 may extend in, include, and/or be defined in a thickness or depth direction 209. The depth direction 209 is represented primarily as an arrow going into or out of the page in the view of FIG. 2, for example. The depth direction 209 may be configured to be aligned with a radially inward direction facing toward the wearer in the worn position and/or to extend between front and rear surfaces of the core member 203, for example. The depth direction 209 may be substantially perpendicular to the length direction 206 and/or the height direction 207, such as in the laid-out flat configuration. However, some degree of tilt may also be present for the depth direction 209 (e.g., to extend radially inward and at least partially downward), such as in situations in which the encircling configuration arranges the core member 203 in a frustoconical orientation and/or in the worn position.

The core member 203 may be formed of suitable material for achieving any of various functions. For example, material for the core member 203 may be suitably durable to facilitate load-bearing and/or supporting gear to be mounted on the duty belt 101. Additionally or alternatively, material for the core member 203 may be suitably flexible to permit bending and/or wrapping around contours of the wearer. The material for the core member 203 may enable bending from a laid-out flat configuration to an encircling configuration and back to a laid-out flat configuration without undergoing permanent or plastic deformation, for example. Examples of suitable material can include chlorosulfonated polyethylene (CPSE), thermoset chlorinated polyethylene (CPE), polyvinyl chloride (PVC) and polyethylene (PE), synthetic rubber, and other examples with suitable durability and/or flexibility.

The core member 203 can include suitable geometry for facilitating functions described herein. Some examples of suitable geometry features may be appreciated with respect to FIG. 2.

The core member 203 may include or exhibit a curvature, such as a bowed curvature. The core member 203 may approximate a saucer shape or a bow shape akin to a bow and arrow, for example. The core member 203 may include the curvature in the laid-out state. The curvature may facilitate arrangement of the core member 203 in a frustoconical arrangement in the worn position, for example.

The curvature may be related to dimensions along the longitudinal axis 205 and/or the length direction 206. For example, the core member 203 may have an upper length along the top margin 208A and a lower length along the bottom margin 208B, and the lower length of the core member 203 may be longer than the upper length of core member 203 such that the core member 203 exhibits a bowed curvature in an at-rest laid out state.

The curvature may correspond to a variation in the height direction 207. The curvature may be measurable by a top-center offset distance 213, which may be determined based on other reference features of the core member 203. For example, the core member 203 may include a center 210 between opposing lateral ends 212 along the longitudinal direction 206. The core member 203 may further define a top reference plane 211. The top reference plane 211 may be arranged to extend through uppermost extremities of the opposing lateral ends 212, such as in the laid-out state. The top reference plane 211 may be aligned with a horizon line or other reference that is normal to the direction of gravity, for example. The top-center offset distance 213 may correspond to a distance between the top reference plane 211 arranged to extend through the uppermost extremities at the opposing ends 212 of the core member 203 and a highest extremity at the center 210 of the core member 203.

In various embodiments, the top-center offset distance 213 may exceed 5 centimeters. As one illustrative example, the core member 203 for one size of belt (e.g., a size small) may include a length of approximately 89 centimeters along the longitudinal axis 205 and a top-center offset distance 213 of 7.5 centimeters. Lengths and/or top-center offset distances 213 may be included in larger amounts for larger sizes (such as for medium, large, extra large, etc.), in smaller amounts for smaller sizes (such as for extra small), and/or in other differing combinations.

In various embodiments, suitably sizing the curvature can allow the core member 203 to adopt a frustoconical orientation in an encircling configuration. A frustoconical orientation can allow a face of the core member to be positioned against the wearer's hip, which may provide a larger surface for distribution of weight than if a lower edge (with smaller profile and thus greater force concentration) of a belt surface is instead positioned in contact as a point load along the wearer's hip. Thus, for example, where a particularly heavy set of equipment to be borne on a belt may be prone to concentrate load through contact of a lower belt edge with hips of the wearer and lead to discomfort and/or negative effects such as bruising and/or hematoma, the same set of equipment may be supported by the core member 203 with weight distributed across a larger area from the frustoconical orientation to avoid such negative effects while supporting a similar set of equipment that may cause such negative effects in other known forms of belts.

In various embodiments, a taper may be included in the core member 203 toward the opposite lateral ends 212. For example, from a given taper starting junction 214, the core member 203 progressing along the longitudinal axis 205 toward the lateral end 212 may generally narrow in the height direction 207. Including a taper may facilitate attachment of buckles for securing the duty belt 101 in the encircling configuration and/or may provide a reduced profile along a front in the worn position to reduce possibility of the duty belt 101 uncomfortably digging in between legs and stomach of a wearer when a wearer bends over or otherwise brings a leg toward the stomach.

The core member 203 can include a series of segments that can include one or more joint segments 215 with two or more support segments 216. Each joint segment 215 may be included between a respective pair of support segments 216. For example, the core member 203 may include a plurality of support segments 216 interspersed by one or more joint segments 215. The core member 203 may be arranged in a pattern of support segments 216 and joint segments 215 alternating with one another. The joint segments 215 may be arranged to divide the support segments 216 among different regions for the wearer's body. For example, a first joint segment 215A and a second joint segment 215B may be arranged on either side of a second support segment 216B that may be sized to be positioned along a back of a wearer, and a first support segment 216A and a third support segment 216C may respectively be sized to extend outward from the first joint segment 215A and the second joint segment 215B to define portions that can extend along the hips and toward a front of the wearer. Although three total support segments 216 (e.g., a first support segment 216A, a second support segment 216B, and a third support segment 216C) and two total joint segments 215 (e.g., a first joint segment 215A and a second joint segment 215B) are shown in FIG. 2, more or fewer may be utilized.

Generally, the support segments 216 may be suitably sized and/or shaped to support gear to be supported by the duty belt 101, and the joint segments 215 may facilitate relative rotation of the support segments 216. The relative rotation of the support segments 216 may be about a rotation axis 218 extending in the depth direction 209, for example. Relative rotation of the support segments 216 may enable the core member 203 to adapt to variations in body shape and size among different wearers (e.g., which may enable faces of the support segments 216 to rest more fully against the body to provide a larger amount of surface area and distribute load more fully than if a portion of the support segment 216 were instead held out of alignment by inflexibility of the core member 203 and resulted in a smaller surface area in contact to distribute load).

The joint segments 215 may include and/or exhibit suitable geometry to facilitate functions of the core member 203. Various examples of features that may contribute to suitable geometry are shown by way of example in FIG. 2.

The joint segments 215 may correspond to necked-down areas. For example, the core member 203 may include a nominal height 217, which may reduce in the height direction 207 at the joint segments 215.

The joint segment 215 may include and/or be accompanied by notches 219. For example, the notches 219 may include a downward notch 219A (which may correspond to an upper notch) and/or an upward notch 219B (which may correspond to a lower notch). The notches 219 may extend along the height direction 207 inwardly and/or centrally from upper and lower extremities (such as the upper margin 208A and the lower margin 208B) of the support segments 216, for example.

The notches 219 may be shaped notches. A shape for the notches 219 may facilitate relative rotation of the support segments 216. The shape of the notches 219 may impart a step function-like shape to the core member 203, such as shapes of the support segments 216 interrupted or alternating with shapes for the joint segments 215. A substantially symmetric extension of the step-function may be present, such as imparting symmetry in the core member 203 in one or more areas across the longitudinal axis 205, across a vertical axis along the height direction 207, or otherwise. The step function-like shape may be continuously differentiable and/or have smooth transitions between the shapes of the support segments 216 and the shapes for the joint segments 215. The support segments 215 may be shaped as bands and be interrupted by the shapes of the notches 219 in the joint segments 215. Some suitable examples of shapes for the notches may include triangular, trapezoidal, half-circular, half-elliptical, bowed, or curved. As a further illustrative example, a triangular shape may provide space between sloped sides that may allow the support segments 216 to rotate toward each other and/or provide suitable limits or stops to the rotation. The triangular shape may correspond to a triangle with a base arranged aligned with the upper margin 208A or the lower margin, with sloped sides extending from the base and toward one another, and with a tip formed from a convergence of the sloped sides and oriented in the height direction 207 toward a middle and/or opposite side of the core member 203. The triangular shape may be established with or without sharp corners. For example, the triangular shape may include at least one radiused or rounded surface along at least one corner of the triangular shape for the notch 219.

The relative dimensions of the notches 219 upward and downward may be symmetrical or may differ from one another. For example, each notch 219 may have a notch height 221 (e.g., extending in the height direction 207), and the notch height 221A of the upper notch 219A may be equal to or differ from the notch height 221B of the lower notch 219B. As a further example, each notch 219 may have a maximum notch width 227 (e.g., aligned and/or along the upper margin 208A and/or the lower margin 208B and/or extending in the length direction 206), which may be equal or different among the upper notch 219A and the lower notch 219B. As another example, each notch 219 may have edges that extend at an angle 229 (e.g., which may be measured relative to the vertical direction 207), and the angle 229 may be equal or different among left and right sides of a given notch 219 and/or among the upper notch 219A and the lower notch 219B. Although the depiction in FIG. 2 may correspond to an angle 229 of approximately 35° from vertical for each side of each notch 219, the angle 229 may be between upper and lower endpoints that may include any of 5°, 10°, 15°, 20°, 25°, 30°, 35°, 40°, 45°, 50°, 65°, 70°, 75°, 80°, or 85°, or other suitable range (or at another orientation, such as to form other shapes described herein).

The joint segment 215 may include a bridge portion 223. The bridge portion 223 may be bounded above and/or below in the height direction 207 by the downward notch 219A and/or the upward notch 219B, for example. The bridge portion 223 and/or the distance between the notches 219 may include and/or be accompanied by a bridge height 225.

Various features of the core member 203 may be sized relative to one another. Such relative sizing may be a ratio or other comparison. Some examples of dimensions and comparisons are provided herein, although it is to be understood that other values may be used additionally or alternatively.

A narrowest portion of the joint segment 215 in the height direction 207 (e.g., the bridge height 225) may be less than 65% (or less than 60%, or less than 55%, or less than 50%, or less than 45%, or less than 40%, or less than 35%, or less than 33%, or less than 30%, or less than 25% or less than 20%, or less than 15%, or less than 10%) of a narrowest portion of the second support segment 216B in the height direction 207 (e.g., between the top margin 208A and bottom margin 208B). As an illustrative example, the bridge height 225 may be approximately 1.4 centimeters, while the second support segment may be 5 centimeters tall (e.g., along the nominal height 217), which may correspond to a ratio of approximately 28%.

An overall length of the joint segment 215 in the longitudinal direction 206 (e.g., the notch width 227) may be less than 55% (or less than 50%, or less than 45%, or less than 40%, or less than 35%, or less than 33%, or less than 30%, or less than 25% or less than 20% or less than 15%, or less than 12%, or less than 10%, or less than 5%) of an overall length of the first support segment 216A in the longitudinal direction 206. As an illustrative example, the notch width 227 may be approximately 2.5 centimeters, while a total length of the first support segment 216A may be approximately 30 centimeters, which may correspond to a ratio of approximately 8%. For example, the total length may include a length of 16.5 centimeters between an edge of the notch 219 and the taper starting junction 214 and another length of 13.5 centimeters between taper starting junction 214 and the lateral end 212. At the taper starting junction 214, the core member 203 may include a nominal height of 5.0 centimeters and may taper down toward 3.65 centimeters at the lateral end 212, as an illustrative example.

An overall length of the joint segment 215 in the longitudinal direction 206 (e.g., the notch width 227) may be less than 45% (or less than 40%, or less than 35%, or less than 33%, or less than 30%, or less than 25% or less than 20%, or less than 12%, or less than 10% or less than 5%) of an overall length of the second support segment 216B in the longitudinal direction 206. As an illustrative example, the notch width 227 may be approximately 2.5 centimeters, while a total length of the second support segment 216B may be approximately 22.5 centimeters (e.g., with a length of 24 centimeters on center between the notches 219), which may correspond to a ratio of approximately 11%.

The notch height 221 may be related to the notch width 227 of a given notch 219. For example, the notch height 221 may be more than 15% (or more than 20%, or more than 30% or more than 40%, or more than 50%, or more than 60%, or more than 70%, or more than 75%, or more than 80%, or more than 90%, or more than 100%, or more than 120%, or more than 150%, or more than 175%, or more than 200%) of the notch width 227. As an illustrative example, the notch height 221 may be approximately 1.8 centimeters, while the notch width 227 may be approximately 2.5 centimeters, which may correspond to a ratio of approximately 72%.

The notch height 221 may be related to the nominal height 217 of the core member 203 along one or more of the support segments 216. For example, the notch height 221 may extend at least 20% (or at least 25% or at least 30%, or at least 33%, or at least 40%, or at least 45%) and less than 50% (such as less than 45%, less than 40%, less than 35% or less than 33%, or less than 30%, or less than 25%) of the nominal height 217. As an illustrative example, the notch height 221 may be approximately 1.8 centimeters, while the nominal height 217 may be approximately 5.0 centimeters, which may correspond to a ratio of approximately 36%.

The core member 203 may be able to flex to allow the duty belt 101 to hinge at the joint segments 215, e.g., based on including suitable features, geometry, dimensions, and/or ratios. For example, the hinging action provided by suitable dimensions (such as with one or more of the ratios described herein) may allow the duty belt 101 to sit along and/or atop the hips in a more comfortable fashion than if the hinging ability were not present. Additionally or alternatively, the hinging may allow the duty belt 101 to avoid crumpling or wrinkles along the length of the joint segments 215 that could cause undue strain in the material and/or discomfort for the wearer (such as when moved toward and/or into the encircling configuration of being worn and/or in a frustoconical orientation). Additionally, or alternatively, the hinging may permit movement or accommodation of different girths of user, for example. Stated another way, in general, the core member 203 may facilitate relative rotation between the support segments 216 about a rotation axis perpendicular to a length of the duty belt 101, which may facilitate suitable hinging when the duty belt 101 is moved toward a frustoconical orientation in a worn configuration to provide an adaptive fit suitable to accommodate variations in waistline shape among different users.

Features of the core member 203 may be formed through any suitable technique. In various examples, the core member 203 may be formed of a single monolithic structure. For example, the first support segment 216A, the first joint segment 215A, the second support segment 216B, the second joint segment 215B, and the third support segment 216C may be formed of a continuous strip of material. Having the core member 203 include a continuous strip extending through at least one joint segment 215 and adjoining support segments 216 can allow portions to remain connected in order to ensure that undesirable lengthening of the belt does not occur (which could otherwise be the case if the material of the joint segment 215 were instead only a connection formed of relatively flexible material). Forming a given notch 219, joint segment 215, and/or support segment 216 may be accomplished by cutting the material or by arranging along projections in a mold that may impart a corresponding void in a fabricated workpiece, for example. Alternative constructions may be possible, such as connecting separate parts by a pin or other suitable structure at one or more joint segment 215.

The core member 203 may be coupled with other components in use. Some examples are described, for example, with respect to FIG. 3 and/or subsequent figures.

Figure 3:
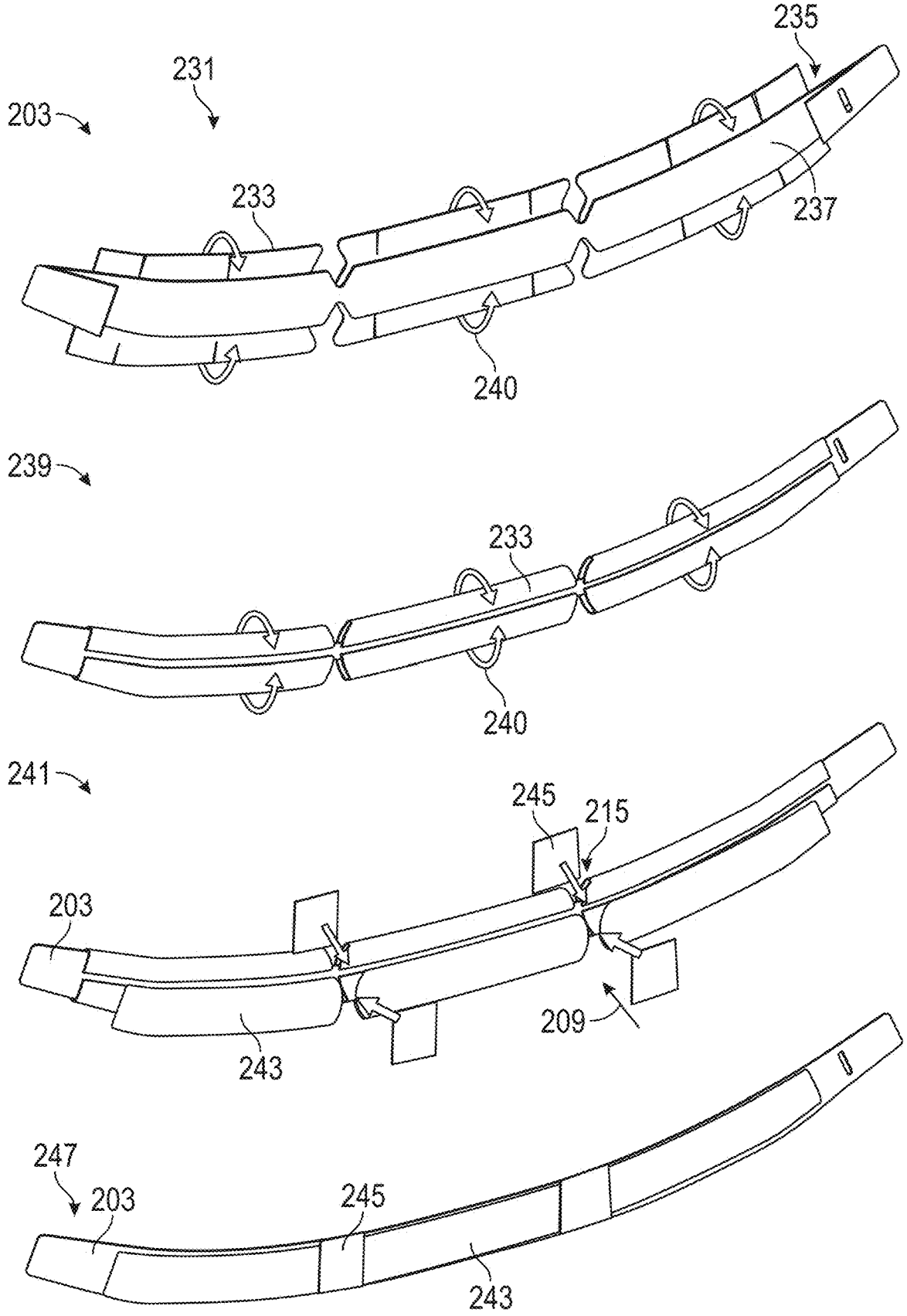
FIGS. 3 and 4 illustrate examples of various components that may be added to the core member of FIG. 2 in accordance with various embodiments.

FIG. 3 shows an example of the core member 203 and other components that may be added. The core member 203 at view 231 is shown with a wrapping 233. The wrapping 233 may be included in sections and/or may wrap around from one side of the core member 203 to another (e.g., to reach the position shown in view 239, such as depicted by arrows 240). The wrapping 233 may be placed against a rear face 235 of the core member 203 and may be wrapped around to arrive in a position along and/or over at least a portion of the front face 237. The wrapping 233 may be formed of a suitable material. For example, the wrapping 233 may be or include a nylon laminate. The wrapping 233 may provide a suitable base for attachment and/or connection with other components.

As shown in view 241 by way of example, components may be applied to the core member 203 and/or other features. For example, a board 243 may be applied, e.g., which may provide a suitable degree of rigidity. As an illustrative example, the board 243 may correspond to a PE board (e.g., formed of polyethylene or polythene). The board 243 may be applied in multiple sections, such as along underlying support segments 216 of the core member 203, for example. Although the board 243 is shown applied over a top of the wrapping 233, the board 243 additionally or alternatively may be applied under at least a portion of the wrapping 233 (if present).

The core member 203 may be supplemented with covers 245. For example, each cover 245 may be formed from a sheet of material that may be placed overlaying a given joint segment 215 in the depth direction 209, e.g., so as to cover the notches 219 and/or joint segments 215 of the core member 203. Each cover 245 may be secured relative to the core member 203. For example, each cover 245 may be secured by stitching through a joint segment 215, a support segment 216, another portion of a cover 245 (e.g., to another cover 245 and/or itself, such as if doubled over or otherwise suitable arranged), and/or other portions of the core member 203 and/or other associated elements that may be present, such as the board 243 and/or the wrapping 233. As an illustrative example, this arrangement may combine elements together into the subassembly shown in the view 247.

The covers 245 may cover the joint segments 215 and/or otherwise avoid or prevent pinching that could be a risk of occurring at the joint segment 215 during relative rotation of the support segments 216. Additionally, or alternatively, the covers 245 may provide a biasing effect. For example, the core member 203 may include a durable material while the sheet that forms the cover 245 may include a flexible sheet that is more stretchable than the durable material. As an illustrative example, the cover 245 may include an elastic webbing, a stretch nylon, and/or another material that is stretchable in one or more directions when loaded and capable of resuming an original size upon cessation of load, which may correspond to being elastic in its sheet plane. The cover 245 may be fixed (e.g., via stitching etc.) at suitable locations to the durable material of the core member 203 such that the stretch characteristics of the flexible sheet of the cover 245 impart a bias toward a default position of the core member 203. For example, the stretch characteristics of the cover 245 may allow the cover 245 and core member 203 to flex and bend to accommodate the contours of a wearer when donned or worn and facilitate moving back toward a flat-laid out state when removed or doffed. Additionally or alternatively, the covers 245 may work against twisting at the joint segments 215, such as twisting about the longitudinal axis 205 that might otherwise cause the duty belt 101 to bind and/or not lay in a fully conforming orientation along the wearer.

Figure 4:
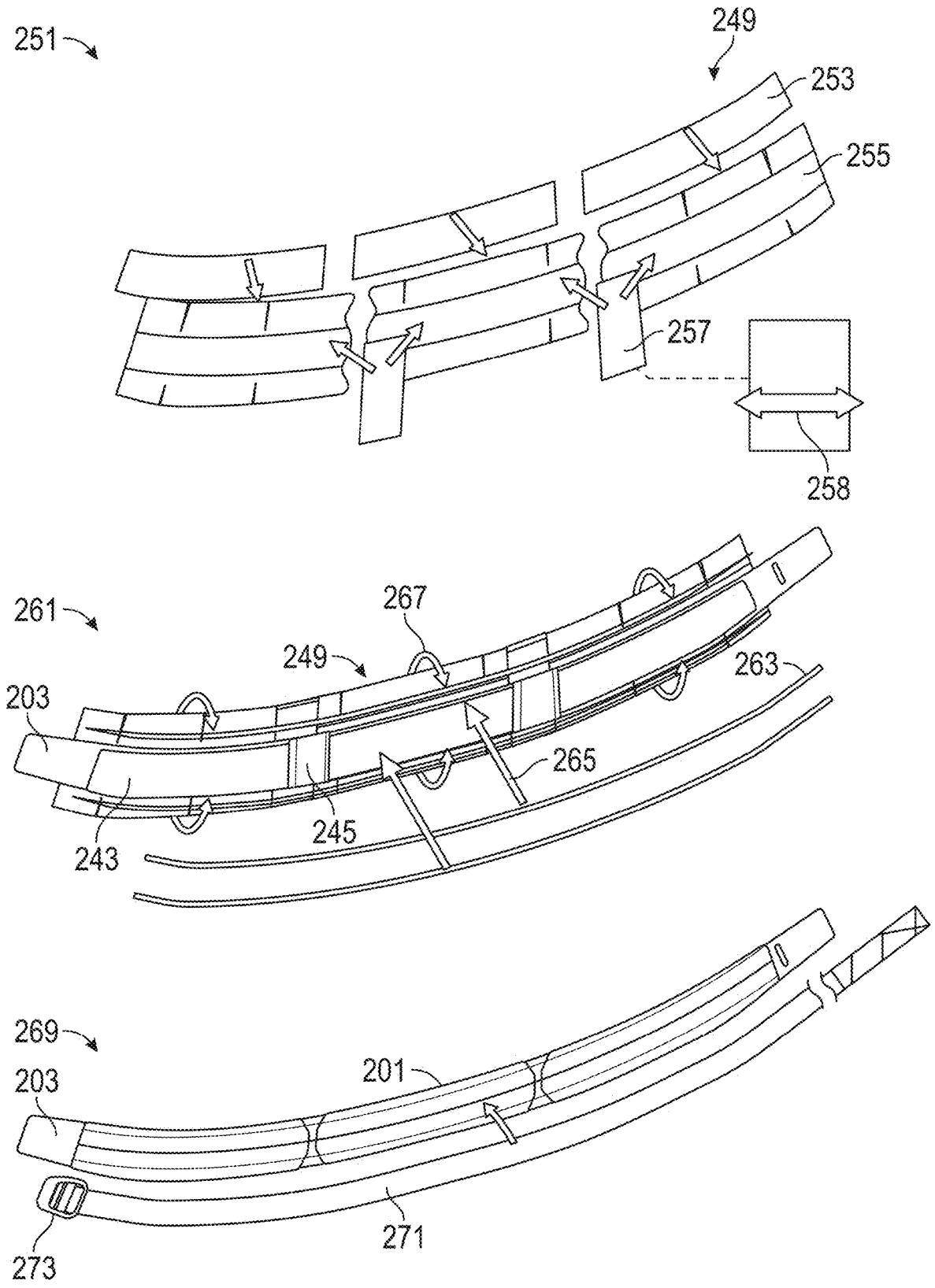

FIG. 4 shows a coupling assembly 249 that may be used with the fabrication process. The coupling assembly 249 may include suitable components to facilitate coupling of the core member 203 in the outer belt 201 (e.g., FIG. 1) with the inner belt 301 and/or other components of the duty belt 101. In view 251 in FIG. 4, various elements that may be included in the coupling assembly 249 are shown by way of example, although any combination of fewer, more, or other components may be utilized.

The coupling assembly 249 may include fastener strips 253. The fastener strips 253 may correspond to hook or loop of hook and loop fasteners, for example. In various examples the fastener strips 253 included on the coupling assembly 249 correspond to hook patches, but may correspond to other structures. The fastener strips 253 may be arranged to be accessible or engageable from an exterior of the coupling assembly 249, for example.

The coupling assembly 249 can include base pieces 255. The base pieces 255 may be suitably sized and arranged for receiving the fastener strips 253 and/or other components. The fastener strips 253 may be stitched or otherwise secured to the base pieces 255, for example. The base pieces 255 can include construction similar or different relative to the wrapping 233. The base pieces 255 may be used in addition or in lieu of the wrapping 233, for example.

The base pieces 255 may be combined or connected with each other with stretch pieces 257. The stretch pieces 257 can include suitable materials such as stretch nylon, elastic webbing, or other materials that may be suitable for the covers 245, although similar or different materials may be utilized among the stretch pieces 257 and the covers 245 (if both are present). The stretch pieces 257 may be arranged to exhibit a stretch direction 258, which may be aligned along the length direction 206 and/or other direction.

As shown by way of example in view 251, the components may be combined together. For example, in a combined state, components may be combined into an assembly in which the stretch pieces 257 connect the base pieces 255. Additionally or alternatively, in a combined state, the fastener strips 253 are attached on a rear side (e.g., which may correspond to a rear side taken in the orientation shown in view 251). The coupling assembly 249 once constructed may be suitable for connecting with other components.

As shown by way of example in view 261, the coupling assembly 249 can be coupled with other elements associated with the core member 203, such as the covers 245 and/or the board 243. The elements can be combined together, for example, with other components such as cords 263, which may include foam or other suitable material. The cords 263 can be suitably placed, such as illustrated by arrows 265 in use. The cords 263 may be arranged along upper and lower bounds of the core member 203, for example. The cords 263 may provide reinforcement and/or some degree of rigidity suitable for the outer belt 201 to receive gear in use, for example. The coupling assembly 249 may be wrapped around the core member 203, such as depicted by arrows 267.

The elements thus assembled may be combined (such as shown in view 269) with a strap 271. The strap 271 that may include a suitable buckle 273 and/or other fasteners to permit securing the outer belt 201 about a waist of the wearer when worn.

Figure 5:
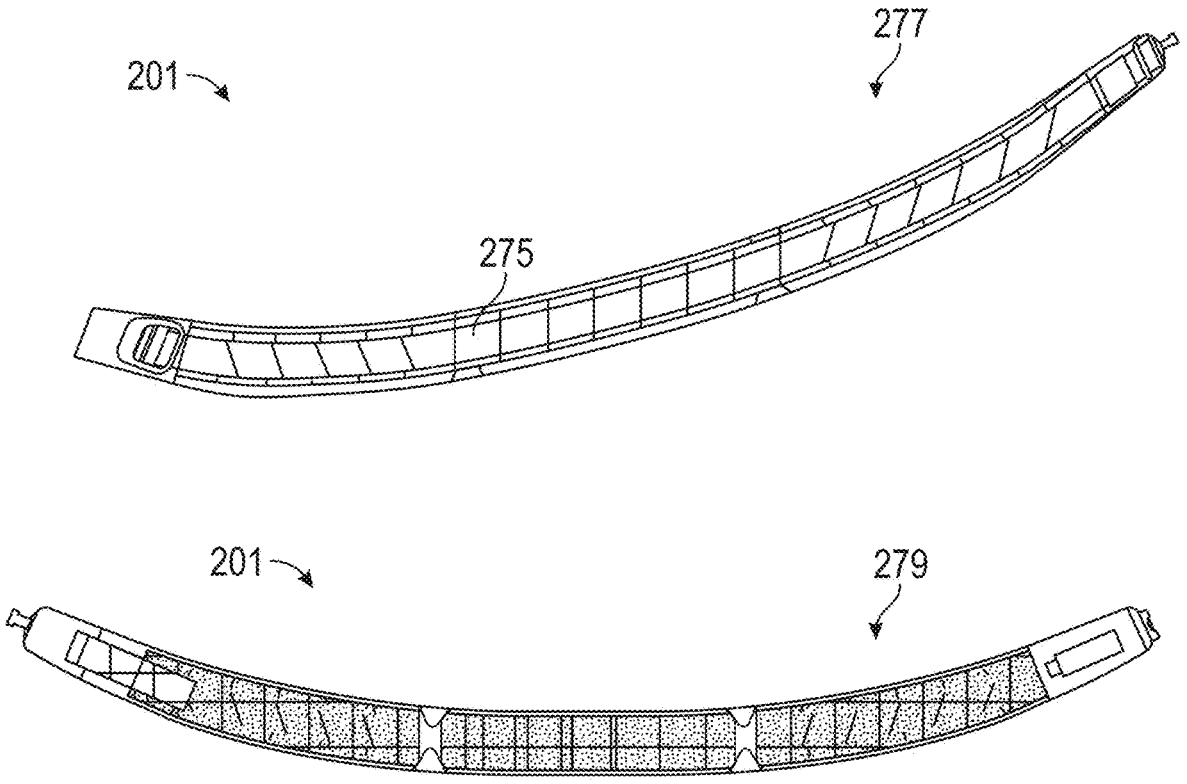
FIG. 5 depicts a rear view and a front view of an example of a completed state of an outer belt for the duty belt of FIG. 1 in accordance with various embodiments.

FIG. 5 depicts a rear view 277 (e.g., showing an outside) and a front view 279 (e.g., showing an inside) of the outer belt 201 in a completed state. The outer belt 201 may be supplemented with suitable stitch lines 275 to produce loops or other attachment features that may be suitable for attachment or compatibility with Modular Lightweight Load-carrying Equipment (MOLLE) systems. For example, the stitch lines 275 between individual adjacent stitch line pairs may define vertically open loops in the strap 271 that may receive MOLLE-compatible gear and/or structures. The outer belt 201 may include suitable features to be combined with other elements of the duty belt 101 in use, such as will be described in later figures after other portions that can be included in the duty belt 101 are described.

Figure 6:
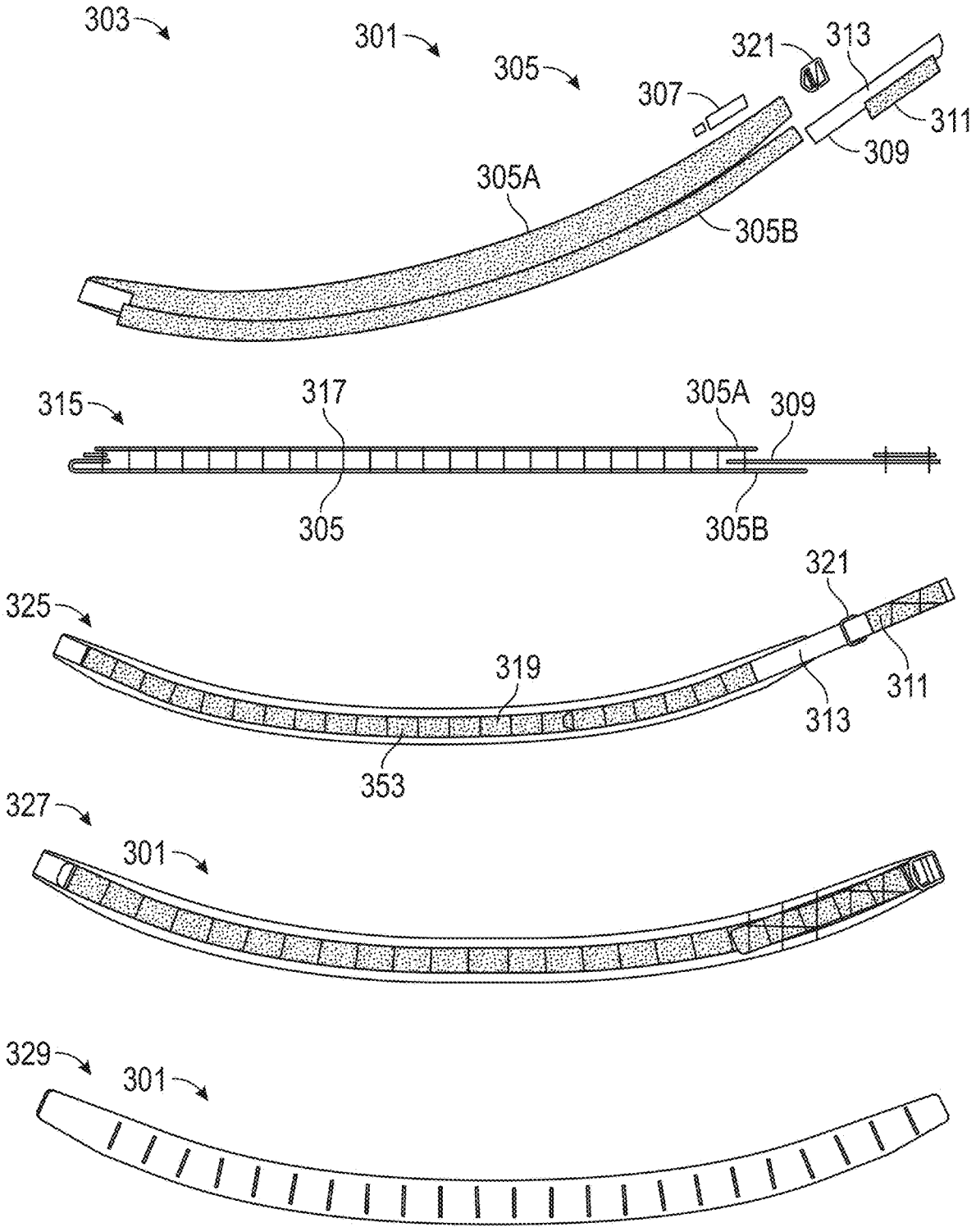
FIG. 6 illustrates an example of a combination of features that may be combined to form an inner belt for the duty belt of FIG. 1 in accordance with various embodiments.

FIG. 6 illustrates a combination of features that may be combined to form the inner belt 301. For example, as may be seen by way of example in view 303, an inner laminate layer 305 may be suitably arranged (such as doubled or laid out in one or more layers 305A, 305B of suitable length for the belt).

The laminate layer 305 may be combined with a tag 307 and/or a fastening portion 309. The fastening portion 309 may correspond to a separate material and/or the end of a strip of the laminate layer 305. The laminate layer 305 and/or the fastening portion 309 may include materials noted for the core member 203 and/or any other suitable material. The fastening portion 309 may include a hook portion 311 and a loop portion 313 in use, although relative positioning may be reversed from the arrangement depicted and/or described.

The parts shown in the view 303 can be suitably connected. As shown in view 315 by way of example, stitching 317 can be extended through respective portions of the laminate layer 305 and/or other components. The fastening portion 309 may be sandwiched between respective layers 305A and 305B of the laminate layer 305 and/or secured to the laminate layer 305 by the stitching 317, for example. The stitching 317 additionally or alternatively may produce suitable loops 319 that may be suitable for MOLLE-attachment, such as may be best seen by way of example in view 325.

As may also be best seen by way of example in view 325, the hook portion 311 and the loop portion 313 may be arranged to be doubled over a buckle 321 or otherwise positioned so as to facilitate length adjustment of the buckle 321 relative to other portions of the inner belt 301. Upon completion of securing the buckle 321 via the hook portion 311 and the loop portion 313 (such as shown at view 325) the inner belt 301 may be ready for securing around a waist of the wearer. As further non-limiting examples of a completed state, the inner belt 301 is further shown in FIG. 6 in a front view 327 and in a rear view 329.

The inner belt 301 may include suitable structure to facilitate connection with and/or being releasably couplable with the outer belt 201. As an illustrative example, the laminate layer 305 and/or other portion of the inner belt 301 may include or be coupled with suitable fastener strips 353. The fastener strips 353 may correspond to mating structure for the fastener strips 253 on the outer belt 201. For example, the fastener strips 353 may correspond to loop structures to facilitate engagement with hook structures of the fastener strips 253 or vice versa.

Figure 7:
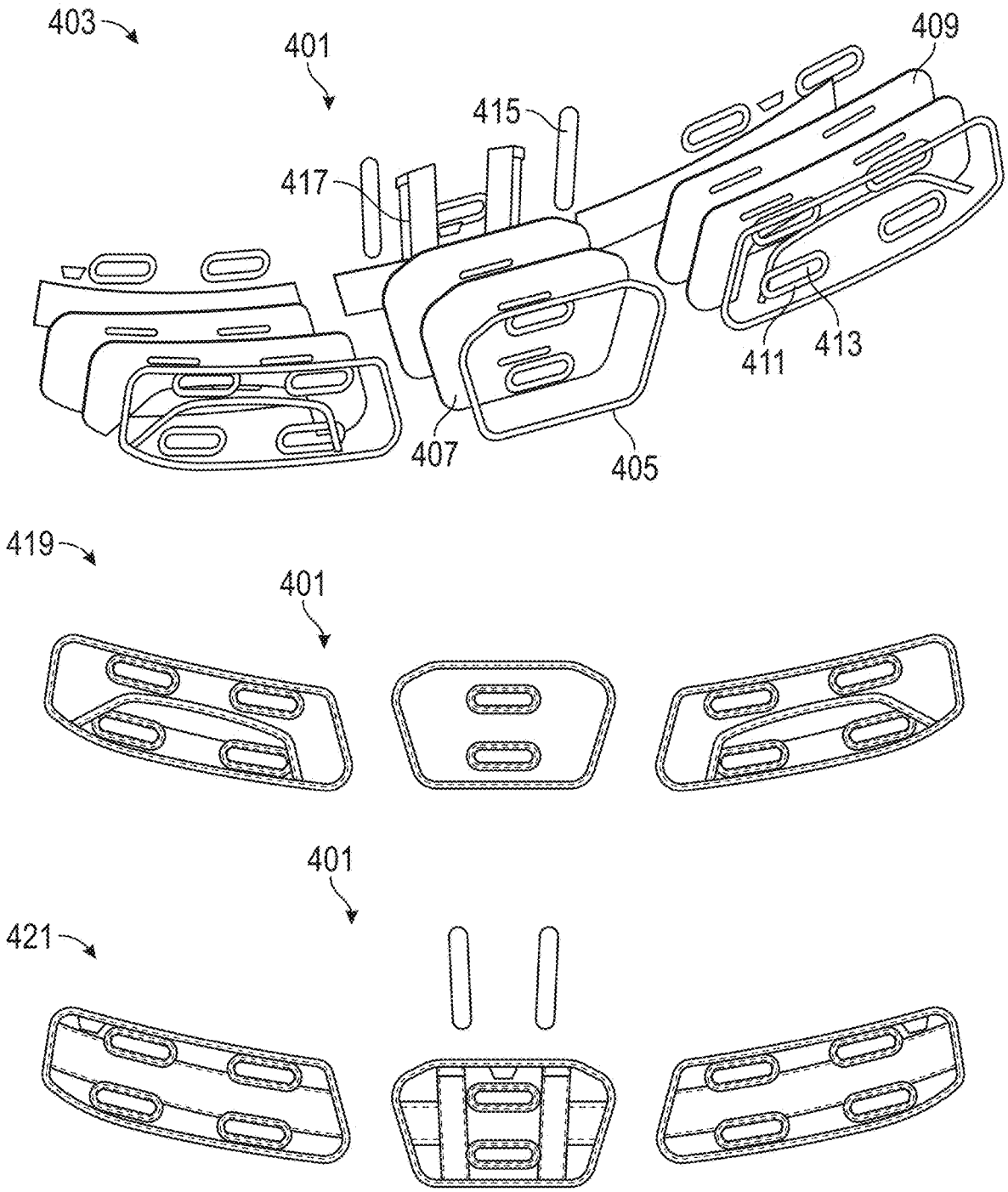
FIG. 7 illustrates an example of a combination of features that may be combined to form pads for the duty belt of FIG. 1 in accordance with various embodiments.

Turning to FIG. 7, pads 401 and suitable components for construction thereof are shown. In a view 403, various exploded layers are shown. A front layer 405 may correspond to cords or other elements that may provide edge binding or other features. Inner layers 407 and backing layers 409 may be included and formed of suitable materials that may be alike or different from one another. Reinforcing grommets 411 and/or other structures may be utilized to provide securing or reinforcement around through-holes 413, which may be present in one or more layers of the pads 401. In some examples, reinforcing grommets 411 may be formed by separate rings of plastic or other suitable material that may be added. Additionally, or alternatively, stitching may be utilized to form the grommets 411 and/or other reinforcing structures. In some examples, inserts 415 may be included. The inserts 415 may be incorporated or implemented with webbing 417 or other suitable structures to define pockets or cavities that can receive the inserts 415 in use. For example, the inserts 415 may be removable to adjust the amount of rigidity of the pads 401 in use. Respectively in FIG. 7, a rear view 419 and a front view 421 are also shown with components combined together to form the pads 401.

Figure 8:
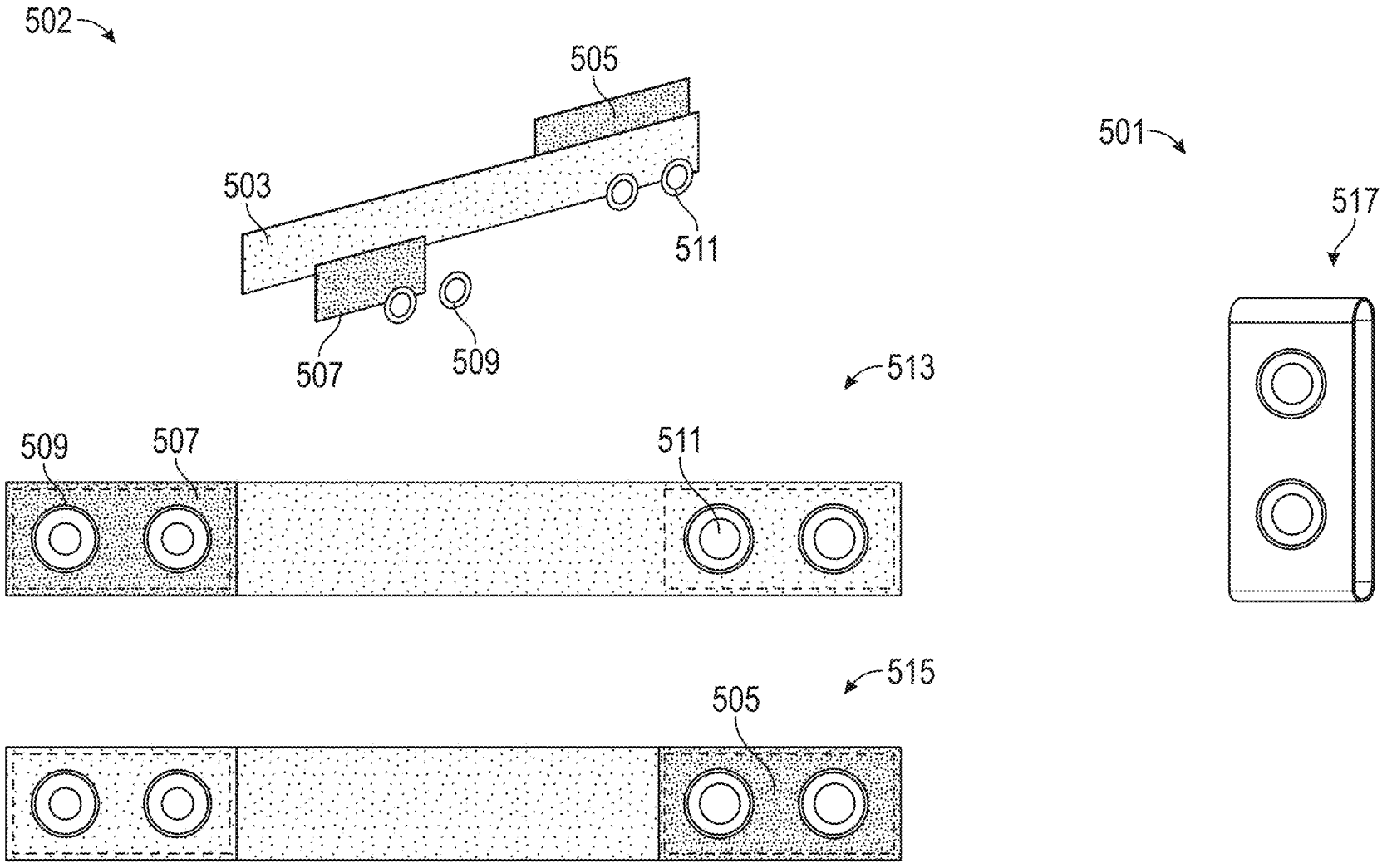
FIG. 8 illustrates an example of a combination of features that may be combined to form keepers for the duty belt of FIG. 1 in accordance with various embodiments.

FIG. 8 illustrates keepers 501 that may be utilized. The keepers 501 can include the parts shown at view 502, for example. The keepers 501 may be formed by strips 503, e.g., which may include nylon webbing or other suitable material. The keepers 501 may include mating features arranged on opposite ends and opposite faces (e.g., front and rear faces). For example, the strips 503 can be accompanied by a hook patch 505 and a loop patch 507. Additionally or alternatively, the keepers 501 can include snaps 509 and snap receivers 511. These may correspond to bosses and sockets, for example. A rear view 513 and a front view 515 of assembled keepers 501 are also shown in FIG. 8. The keepers 501 may be arranged to have the snap 509 along the loop patch 507 and the snap receiver 511 along the hook patch 505 or vice versa. These features can be on opposite sides such that the keepers 501 can be looped from one end to the other to align for engagement, e.g., so that the hook patch 505 and the loop patch 507 on opposite sides of the strips 503 will be brought into contact with each other and/or so that the ends are connected and/or reinforced by engagement of the snaps 509 with the snap receivers 511. A completed keeper 501 (e.g., that has been doubled back and connected to itself to provide a ring) is also shown in view 517, for example.

Figure 9:
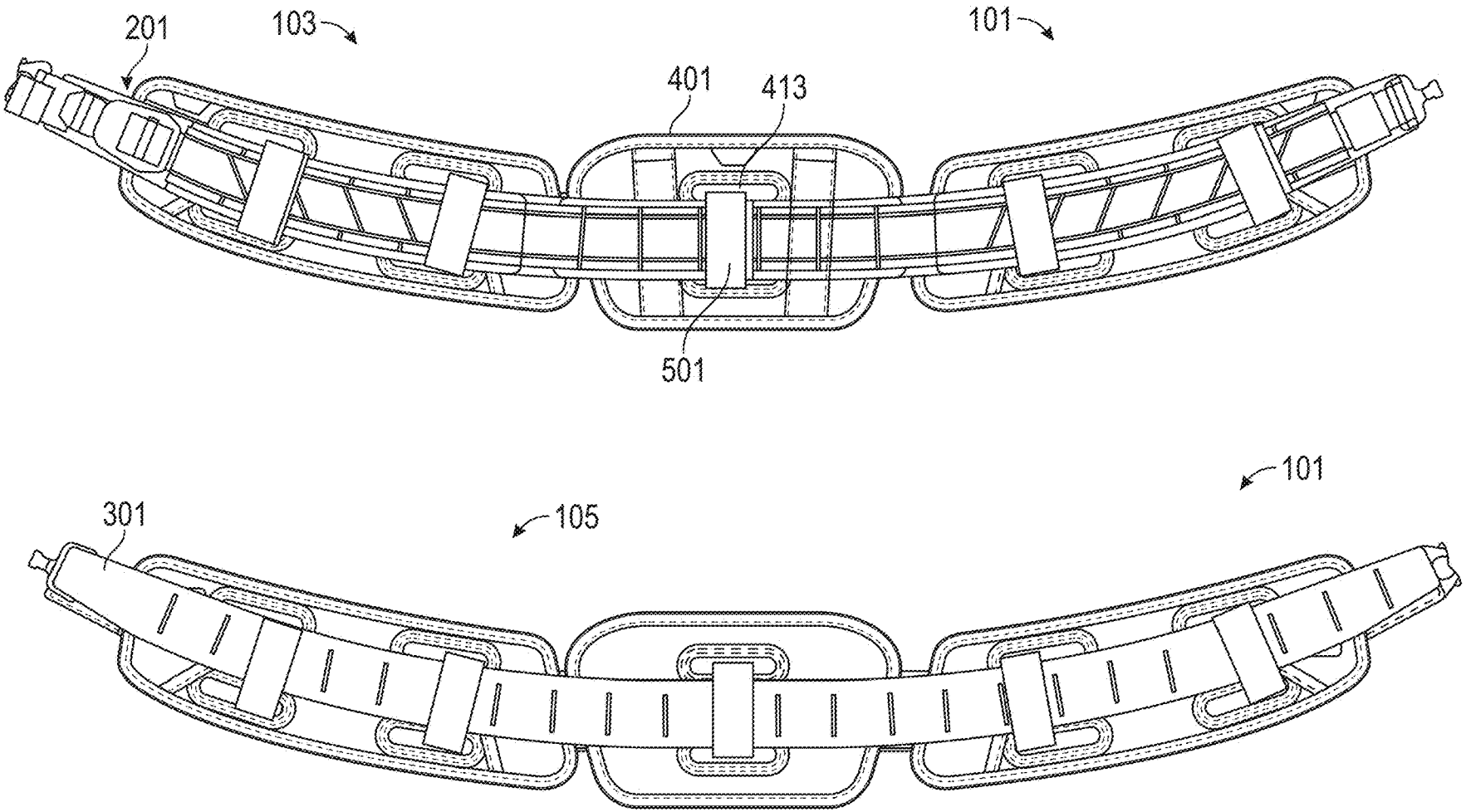
FIG. 9 illustrates a front view and a rear view of an example of an assembled state of the duty belt of FIG. 1 in accordance with various embodiments.

FIG. 9 shows a front view 103 and a rear view 105 of an example of the duty belt 101 in an assembled state. The views show some options for relative arrangement of components, such as with the keepers 501 extending through the through-holes 413 in the pads 401 and about the inner belt 301 and/or the outer belt 201. Although the pads 401 are shown in FIG. 9 in a state of being captured in between the outer belt 201 and the inner belt 301 (e.g., radially inward of the outer belt 201 and radially outward of the inner belt 301), the pads 401 may be arranged to be inward or outward of the outer belt 201 and/or the inner belt 301.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A duty belt comprising:

a core member having a longitudinal direction configured to at least partially encircle a wearer along hips of the wearer in a worn position, the core member further having a height direction configured to be aligned with a direction of gravity in the worn position, the core member further having a depth direction configured to be aligned with a radially inward direction facing toward the wearer in the worn position, the core member comprising a series of segments including:

a first support segment;

a second support segment; and a joint segment connecting the first support segment and the second support segment, the joint segment comprising a bridge portion bounded above and below in the height direction by notches, wherein the core member is sized such that a narrowest portion of the joint segment in the height direction is less than 65% of a narrowest portion of the second support segment in the height direction, wherein the joint segment is configured to facilitate relative rotation between the first support segment and the second support segment about a rotation axis extending in the depth direction; and a sheet of flexible material overlaying the joint segment in the depth direction and having stretch characteristics biasing the core member toward a default position.

2. The duty belt of claim 1, wherein the core member has an upper length along a top margin and a lower length along a bottom margin, and wherein the lower length of the core member is longer than the upper length of the core member such that the core member exhibits a bowed curvature in an at-rest laid out state.

3. The duty belt of claim 2, wherein the core member includes a center between opposing ends along the longitudinal direction, wherein the bowed curvature is measurable by a top-center offset distance, wherein the top-center offset distance corresponds to a distance between a top plane arranged to extend through uppermost extremities at the opposing ends of the core member and a highest extremity at the center of the core member, and wherein the bowed curvature is such that the top-center offset distance is exceeding 5 centimeters.

4. The duty belt of claim 1, wherein the core member is sized such that an overall length of the joint segment in the longitudinal direction is less than 45% of an overall length of the second support segment in the longitudinal direction.

5. The duty belt of claim 1, wherein the notches are triangular notches and the core member comprises at least one radiused or rounded surface along at least one corner of the notches.

6. The duty belt of claim 1, wherein the joint segment is a first joint segment, and wherein the core member further comprises:

a third support segment; and a second joint segment connecting the third support segment and the second support segment, the second joint segment comprising a second bridge portion bounded above and below in the height direction by notches, wherein the second joint segment is configured to facilitate relative rotation between the third support segment and the second support segment about a second rotation axis extending in the depth direction.

7. The duty belt of claim 1, further comprising:

an outer belt that contains the core member; and an inner belt releasably couplable with the outer belt.

8. A core member for a duty belt, the core member comprising:

a series of segments that include:

a first support segment;

a second support segment; and a joint segment connecting the first support segment and the second support segment, the joint segment comprising a bridge portion bounded above and below by notches, wherein a narrowest portion of the joint segment in a height direction is less than 65% of a narrowest portion of the second support segment in the height direction, wherein the core member is supplemented with a cover formed from a sheet of material overlaying the joint segment, and wherein the core member comprises a first material and the sheet comprises a flexible sheet that is more stretchable than the first material and is fixed to the first material such that stretch characteristics of the flexible sheet impart a bias toward a default position of the core member.

9. The core member of claim 8, wherein the series of segments includes a pattern of support segments and joint segments alternating with one another.

10. The core member of claim 8, wherein the core member has an upper length along a top margin and a lower length along a bottom margin, and wherein the lower length of the core member is longer than the upper length of the core member.

11. The core member of claim 8, wherein the core member is sized such that an overall length of the joint segment in a longitudinal direction is less than 45% of an overall length of the second support segment in the longitudinal direction.

12. The core member of claim 8, wherein the first support segment, the joint segment, and the second support segment are formed of a continuous strip of material.

13. A method, comprising:

accessing a core member comprising a series of segments that include:

a first support segment;

a second support segment; and a joint segment connecting the first support segment and the second support segment, the joint segment comprising a bridge portion bounded above and below by notches, wherein a narrowest portion of the joint segment in a height direction is less than 65% of a narrowest portion of the second support segment in the height direction; and incorporating the core member into a belt, wherein incorporating the core member into a belt comprises attaching a sheet of material that is more flexible than the core member in a position overlaying the joint segment.

14. The method of claim 13, wherein incorporating the core member into a belt comprises incorporating the core member into an outer belt, and wherein the method further comprises coupling the outer belt with an inner belt to form a duty belt.

15. The method of claim 13, further comprising coupling the core member with pads.

16. The method of claim 13, further comprising coupling the core member with a second belt.

17. The method of claim 13, further comprising coupling the core member with keepers configured for holding separable parts together.

* * * * *